United States Patent [19]

Lieberman

[11] 4,394,787

[45] Jul. 26, 1983

[54] HYDRAULIC DOOR CLOSER CONSTRUCTION

[75] Inventor: Sidney Lieberman, Lancaster, Pa.

[73] Assignee: Dorma Door Controls Inc., Reamstown, Pa.

[21] Appl. No.: 928,403

[22] Filed: Jul. 27, 1978

[51] Int. Cl.[3] ..... E05F 3/14

[52] U.S. Cl. ..... 16/58; 16/62; 277/DIG. 3; 285/351

[58] Field of Search ..... 16/49, 51, 62, 59, 55, 16/58; 277/DIG. 3, 9, 123, 125, 124; 285/DIG. 19, 351, 382; 308/187.1, 238

[56] References Cited

U.S. PATENT DOCUMENTS

| | | | |
|---|---|---|---|
| 633,682 | 9/1899 | Cliff | 16/62 |
| 1,178,688 | 4/1916 | Stronach | 16/62 |
| 1,220,469 | 3/1917 | Smith | 16/62 |
| 2,485,976 | 10/1949 | Main | 285/351 X |
| 2,705,177 | 3/1955 | Waring | 285/DIG. 19 |
| 2,757,053 | 7/1956 | Green | 308/187.1 |
| 2,765,185 | 10/1956 | Mott | 277/124 |
| 3,076,683 | 2/1963 | Hanley | 308/238 X |
| 3,106,743 | 10/1963 | Ellis et al. | 16/55 |
| 3,160,426 | 12/1964 | Faeser | 285/351 X |
| 3,194,589 | 7/1965 | Kahlbau et al. | 277/125 X |
| 3,485,142 | 12/1969 | Kutas et al. | 277/125 X |
| 3,546,734 | 12/1970 | Pollack et al. | 16/62 X |
| 4,080,687 | 3/1978 | Jentsch | 16/51 X |

OTHER PUBLICATIONS

Parker Seal Company, 1971, pp. 1–8, 1–9, 6–21, 6–22, 6–23.

*Primary Examiner*—Kenneth Dorner
*Attorney, Agent, or Firm*—Robert C. Podwil

[57] ABSTRACT

A hydraulic door closer is provided with a fluid seal for its output shaft, the seal comprising multiple O-rings disposed side-by-side in an elongated annular chamber.

5 Claims, 3 Drawing Figures

FIG. 1
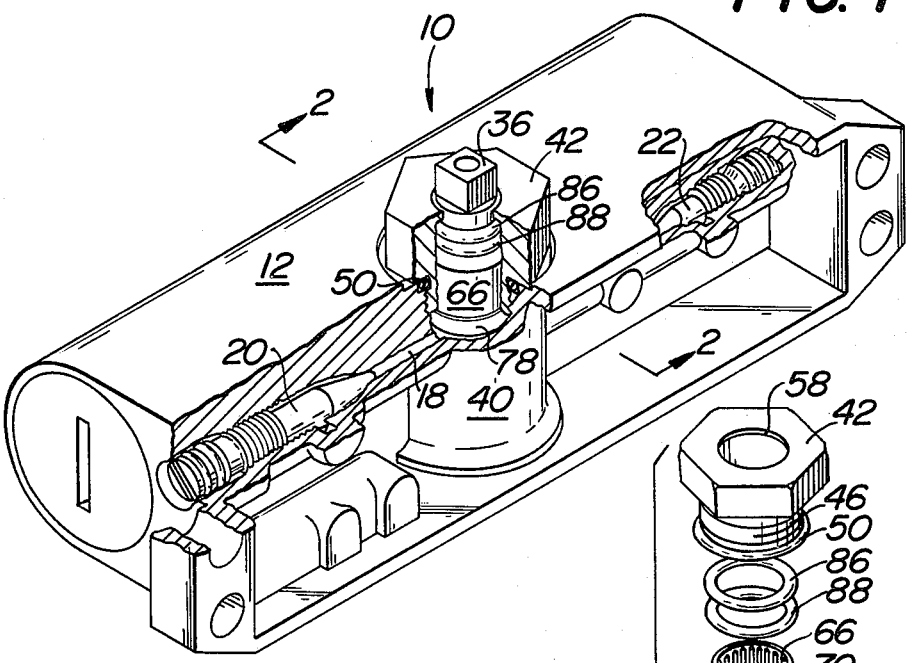
FIG. 3
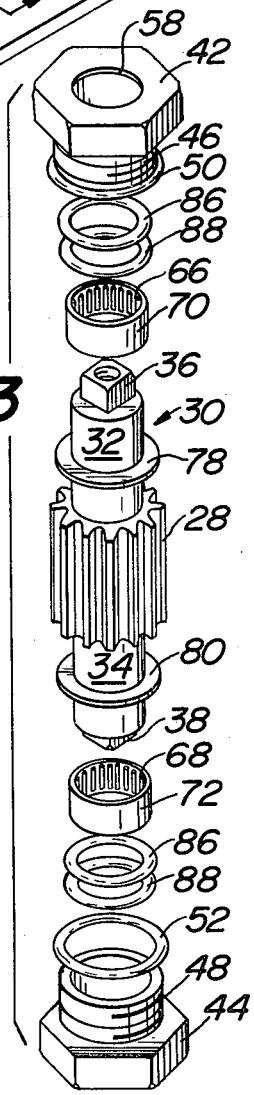
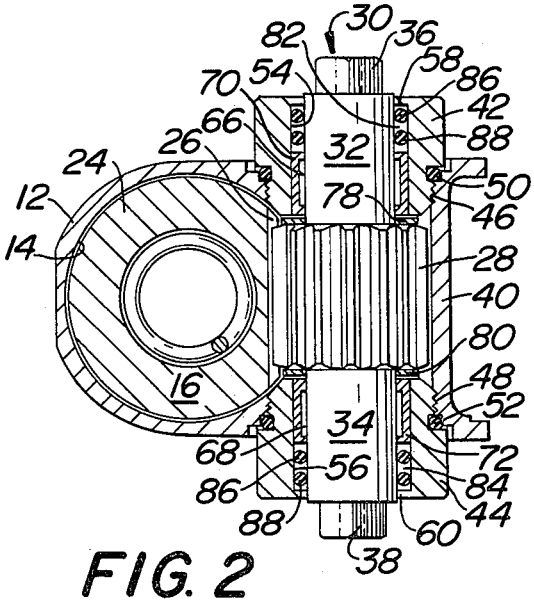
FIG. 2

HYDRAULIC DOOR CLOSER CONSTRUCTION

BACKGROUND OF THE INVENTION

This invention relates to hydraulic door closer apparatus, and more particularly, to hydraulic door closer apparatus having a novel fluid seal construction. In general, this invention relates to the type of hydraulic door closer apparatus disclosed in U.S. Pat. No. 4,019,220, issued Apr. 26, 1977 to Sidney Lieberman, and assigned to the assignee of the present application, and U.S. Pat. No. 3,426,382, issued Feb. 11, 1969 to T. R. Lasier et al., in which a spring-urged hydraulic piston is arranged to bias a door to its closed position with appropriate hydraulic damping. Typically, in the use of apparatus of this sort, the force generated by a spring is transmitted between the door closer and, depending upon where the door closer is mounted, either a door or door frame. For this purpose, it is usual to provide a linkage consisting of a pair of links, coupled to the door closer and to the door or door frame, as the case may be.

As in the patents referred to above, a rack and pinion arrangement is used to convert the linear motion of the piston within the door closer to rotary or oscillatory motion of an output shaft and the linkage.

Upon opening of the door, the piston is driven by the pinion against the bias of a return spring and against fluid resistance provided by hydraulic circuitry within the device. The hydraulic circuitry is usually made adjustable to provide for variable cushioning or a "back-check" effect as the door approaches the limits of its swing toward the open position. Movement of the door toward the closed position is accomplished by unloading of the return spring, with the speed of closing controlled by damping provided by the hydraulic circuitry.

Since the housing for hydraulic door closers of the above-described type contains hydraulic fluid under pressure, the retention of that fluid free from leakage is an important design requirement. Of particular concern from the standpoint of service life has been the dynamic seal between the housing and the rotary output shaft. Such seals are expected to withstand many thousands of cycles of operation without failure (failure being defined as detectable fluid leakage), and they must do so notwithstanding the potentially degrading effects of wear and age, dust and other external contaminants, contaminants in the hydraulic fluid, variations in ambient and operating temperatures, and wear between moving parts.

With reference to the above mentioned patent to Lasier et al., one shaft sealing technique which has conventionally been used involves the resilient sealing device known as an "O-ring". O-ring seals, which are conventionally used in both rotary and recipricatory applications, use a resilient sealing member or O-ring, usually circular in transverse cross-section, loosely associated with a straight-sided annular groove having a height and width corresponding approximately to the dimensions of the sealing member but not conforming to its cross-section. In such devices, as is well known, dynamic and static pressure in the working fluid causes the sealing member to deform and press against the groove and adjacent working parts to provide the desired sealing effect. Thus, the O-ring, by virtue of its inherent characteristic, reacts and accommodates itself to variations in pressure and irregularities in the surfaces of the member or members against which it works.

O-rings are deceptively simple in appearance, and experience with them as shaft seals for door closers has shown that in a percentage of cases, O-rings apparently regular in appearance will nevertheless prove, in conventional seal structures, to permit leakage. It has also been found with conventional constructions that in a demonstrable fairly constant percentage of assemblies, failure will occur within a relatively small number of cycles of operation.

The present invention relates to a door closer construction in which O-rings are used for shaft sealing purposes, but in which the useful life of the seal is greater than in conventional constructions and the seal is less sensitive than conventional constructions to O-ring condition.

The foregoing and other objects of this invention are realized, in the presently preferred form of the invention by a shaft seal in which the output shaft of a door closer is supported in the housing of the door closer by bearings at both ends. The bearings and packing nuts associated with them provide an annular chamber or groove for multiple O-rings, preferably a pair of O-rings.

It is recognized that some of the advantage of the present invention may result from the fact that one of the preferred pair of O-rings merely serves as a backup to the other, the probability of both being grossly defective being extremely small. Surprisingly, however, it has been found in testing examples of the present invention, that use of two O-rings, each of which permits leakage in a conventional O-ring seal can nevertheless provide a reliable leak-free seal.

For the purpose of illustrating the invention, there is shown in the drawings a form of the invention which is presently preferred, but it should be understood, however, that the invention is not limited to the precise arrangement and instrumentalities shown.

FIG. 1 is a perspective view, in partial cutaway, of hydraulic door closer apparatus which embodies the present invention.

FIG. 2 is a cross-sectional view, taken along the line 2—2 in FIG. 1.

FIG. 3 is an exploded view showing details of the present invention.

Referring now to the drawings in detail, wherein like numerals indicate like elements, there is seen in FIG. 1 hydraulic door closer apparatus designated generally by the referenced numeral 10. The apparatus 10 is of the general type described in the above-mentioned U.S. Pat. Nos. 3,426,382 and 4,019,220.

Thus, the door closer apparatus 10 includes a housing 12 which, with reference to FIG. 2, contains within it a bore 14 in which a piston 16 reciprocates.

Referring again to FIG. 1, the housing 12 has within it a reservoir of fluid, and fluid passages, of which the passage 18 is an example, through which fluid can flow in the operation of the apparatus 10. Adjustable valves 20 and 22 are associated with the passages, and control fluid flow to regulate the action of the apparatus 10.

Referring again to FIG. 2, the piston 16 typically comprises a main or body portion 24 and a rack portion 26 (which may be integral with the body portion or provided as a separate element as in the above mentioned U.S. Pat. No. 4,019,220). The rack portion 26 engages a pinion 28 associated with an output shaft designated generally by the reference numeral 30. The output shaft 30 in the illustrated form of the invention includes a pair of oppositely extending cylindrical shaft portions 32 and 34, provided at their respective ends with suitable bosses, lugs or other means 36, 38 for affixing the linkage (not shown) to the output shaft 30.

Referring now to FIGS. 2 and 3, the manner in which the output shaft 30 of the present invention is coupled to and supported within the housing 12, and by which a simple and reliable fluid seal is effected between the housing 12 and the output shaft 30, will now be described in detail.

The housing 12 is provided with a generally cylindrical boss 40, the bore of which intersects the bore of the cylinder in which the piston 16 is disposed. The output shaft 30 is positioned in the boss 40 with the pinion 28 in engagement with the rack 26.

In the illustrated embodiment, the boss 40 is closed at its respective ends by a pair of bearing-supporting packing nuts 42, 44, affixed to the case or housing 12 by screw threads 46, 48. Suitable fluid seals, such as gaskets or the illustrated O-rings 50, 52 are provided between the packing nuts 42, 44 and the case or housing 12.

The packing nuts 42, 44 are provided with internal bores 54, 56 of an internal diameter exceeding the outside diameter of the cylindrical shaft portions 32, 34. Lip portions 58, 60 extend inwardly from the bores 54, 56, to provide openings in the packing nuts 42, 44 corresponding generally to the outer diameter of the cylindrical shaft portions 32, 34.

Received within the bores 54, 56 are bearing assemblies 66, 68. In the illustrated and preferred form of the invention, the bearing assemblies 66, 68 are of the "needle" type, well adapted to accept the heavy transverse forces to which the output shaft 30 may be subjected in its service. The bearing assemblies 66, 68 include portions 70, 72 which extend into the bores 54, 56 of the packing nuts 42, 44. Washers 78, 80 or the like are advantageously provided on the cylindrical shaft portions 32, 34 to accommodate and compensate for axial thrust on the output shaft 30.

The inner walls of the above-mentioned lip portions 58, 60 and respective side walls of the bearing assemblies 66, 68 provide respective end walls of elongated annular chambers 82 and 84, the curved inner and outer walls of the chambers 82, 84 being defined by the outer surfaces of the cylindrical shaft portions 32, 34 and the walls of the bores 54, 56.

Each chamber 82, 84 encloses a pair of O-rings 86, 88, the dimensions of which correspond to the dimensions of the chambers 82, 84 to permit working of the O-rings 86, 88. The O-rings, 86, 88 are of a conventional type, preferably of circular cross-section and are disposed side-by-side in the chambers 82, 84. The axial dimensions of the chambers 82, 84 are, however, in the presently preferred embodiment, in excess of the combined axial dimension (thickness) of the O-rings 86, 88, so that, under the influence of fluid pressure, the O-rings 86, 88 can adjust themselves axially within the chambers 82, 84.

Although, in the illustrated embodiment, both bearing assemblies 66 and 68 are retained by removable packing nuts (the packing nuts 42 and 44), in another practical embodiment, the function of one of the packing nuts may be served by a fixed packing member or boss, not shown, cast integrally with the housing 12.

In operation, fluid pressure causes the O-rings 86, 88 to deform and effect a seal between the cylindrical shaft portions 32, 34 and the packing nuts 42, 44.

It will be recognized that the present invention may be embodied in other specific forms without departing from its spirit or essential attributes. Accordingly, reference should be made to the appended claims rather than the foregoing specification as indicating the scope of the invention.

I claim:

1. For use in hydraulic door closer apparatus of the type comprising a housing having a cylinder therein, a piston disposed in said cylinder, rotary output shaft means journalled in said housing, and means mechanically interconnecting said piston and said output shaft for transmitting forces to and from said piston and said output shaft, a fluid seal for said output shaft comprising a cylindrical surface on said shaft adjacent to an end thereof, and an elongated annular chamber surrounding a portion of said surface and having a pair of axially spaced end walls, and a pair of O-ring members disposed side-by-side in said chamber, the axial dimension of said chamber being greater than the combined axial dimension of said O-ring members, so that said O-ring members can adjust themselves axially within said chamber.

2. Apparatus in accordance with claim 1, and bearing means supporting said output shaft with respect to said housing, a portion of said bearing means defining one end wall of said chamber.

3. Apparatus in accordance with claim 2, and a packing member adapted to be coupled to said housing and having an internal bore therein, said bearing means being received in said bore, and a lip projecting inwardly from said bore toward said surface of said output shaft, said bore and said lip defining, respectively, said cylindrical outer wall and are end walls of said chamber.

4. Hydraulic door closer apparatus comprising a housing having a cylinder therein, a piston disposed in said cylinder, rotary output shaft means journalled in said housing, means mechanically interconnecting said piston and said output shaft for transmitting forces to and from said piston and said output shaft, and fluid seal means for said output shaft, said fluid seal means comprising an elongated annular chamber surrounding said shaft, said chamber having a cylindrical outer wall and axially spaced end walls, and a pair of O-ring members disposed side-by-side in said chamber, the width of said chamber in the axial direction of said shaft means being greater than the combined thickness of said O-ring members, so that said O-ring members can adjust themselves axially within said chamber.

5. Hydraulic door closer apparatus comprising a housing having a cylinder therein, a piston disposed in said cylinder, rotary output shaft means journalled in said housing, means mechanically interconnecting said piston and said output shaft for transmitting forces to and from said piston and said output shaft, and fluid seal means for said output shaft, said fluid seal means comprising an elongated annular chamber surrounding said shaft, said chamber having a cylindrical outer wall and axially spaced end walls, and a pair of O-ring members disposed side-by-side in said chamber, the axial dimension of said chamber being greater than the combined axial dimension of said O-ring members, so that said O-ring members are axially movable within said chamber, bearing means supporting said output shaft with respect to said housing, a portion of said bearing means defining one end wall of said chamber, a packing member associated with said housing and having an internal bore therein, said bearing means being received in said bore, and a lip projecting inwardly from said bore toward said surface of said shaft, said bore and said lip defining, respectively, said cylindrical outer wall and one end wall of said chamber.

* * * * *